US007129805B2

(12) United States Patent
Marion et al.

(10) Patent No.: US 7,129,805 B2
(45) Date of Patent: Oct. 31, 2006

(54) METHOD OF INCREASING THE OPERATING FREQUENCY IN A SERIES-SHUNT CONFIGURED PIN DIODE SWITCH

(75) Inventors: Donald G. Marion, Deerfield, NH (US); Annemarie Giza, Deerfield, NH (US)

(73) Assignee: Continental Microwave & Tool Company, Inc., Exeter, NH (US)

( * ) Notice: Subject to any disclaimer, the term of this patent is extended or adjusted under 35 U.S.C. 154(b) by 93 days.

(21) Appl. No.: 11/048,423

(22) Filed: Feb. 1, 2005

(65) Prior Publication Data

US 2006/0170516 A1 Aug. 3, 2006

(51) Int. Cl.
*H01P 1/10* (2006.01)

(52) U.S. Cl. ..... 333/103; 333/104

(58) Field of Classification Search ..... 333/101, 333/103, 104, 262, 17.2; 385/17; 318/254; 257/777

See application file for complete search history.

(56) References Cited

U.S. PATENT DOCUMENTS 3,593,205 A * 7/1971 Coraccio et al. ..... 333/103
3,629,732 A * 12/1971 King et al. ..... 333/104
3,774,123 A 11/1973 Hume
4,220,874 A 9/1980 Iwata et al.
4,571,559 A * 2/1986 Henry et al. ..... 333/17.2
4,883,984 A 11/1989 Kess
5,170,139 A 12/1992 Nelson
5,212,408 A 5/1993 Even-or
5,710,463 A * 1/1998 Vogel et al. ..... 257/777
5,889,374 A * 3/1999 Pezzani ..... 318/254
5,990,580 A 11/1999 Welgand
6,356,166 B1 3/2002 Goldsmith et al.
6,445,839 B1 * 9/2002 Miller ..... 385/17
6,552,626 B1 4/2003 Sharpe et al.
6,697,605 B1 2/2004 Atokawa et al.

OTHER PUBLICATIONS

Theresa Corrigan and Ray Goggin, CMOS "Switches Offer High Performance in Low Power, Wideband Applications," High Frequency Electronics, Feb. 2004, p. 40-46, Copyright 2004 Summit Technical Media, LLC.

* cited by examiner

*Primary Examiner*—Dean Takaoka
(74) *Attorney, Agent, or Firm*—Jaeckle Fleischmann & Mugel, LLP

(57) ABSTRACT

The vertical placement of the series and shunt PIN diodes of a microline series-shunt PIN diode switch results in an increased upper frequency limit of the switch.

13 Claims, 8 Drawing Sheets

METHOD OF INCREASING THE OPERATING FREQUENCY IN A SERIES-SHUNT CONFIGURED PIN DIODE SWITCH

TECHNICAL FIELD

The present invention relates to PIN diode switches, and more particularly, to PIN diode switches in a series-shunt configuration.

BACKGROUND OF THE INVENTION

PIN diode switches, when used in high frequency switching applications, can be configured is many different ways. The most common configuration is a series-shunt switch to achieve a multiple throw, broadband, fast switching and good isolation with moderate insertion loss and moderate power handling capabilities. However, as the upper RF frequency increases above 8 or 10 GHz performance is limited by several factors, including the minimum achievable PIN diode parameters, mainly the junction capacitances. To lessen the effect of the junction capacitance it is standard practice in the prior art to mount the shunt PIN diode as close as possible to each series PIN diode. But no matter how close the shunt and series PIN diodes are to each other, there is still a length of transmission line required to make the connection. As the RF or data signal frequency is increased, this length of transmission line degrades the performance and ultimately creates an upper frequency limit. This limit is classically around 18 or 20 GHz.

It is a principal object of the present invention to minimize losses in efficiency as the frequency of the data signal is increased in order to raise the upper frequency limit.

It is also an object of the present invention to minimize such losses by relatively simple and inexpensive changes in the layout of the PIN diode switch.

SUMMARY OF THE INVENTION

Briefly described, a microline series-shunt configured PIN diode switch has the series PIN diode and the shunt PIN diode for each arm of the switch substantially vertically aligned with each other.

Also described is the fabrication of a series-shunt PIN diode switch that includes the steps of mounting a shunt PIN diode in an opening of a circuit board and mounting a series PIN diode on a surface of the circuit board substantially directly above the shunt PIN diode.

Additionally described is a switch with first and second PIN diodes having their respective anodes connected together at a first node of said switch. The first and second PIN diodes lie substantially on the top surface of a dielectric plate, the bottom surface of the dielectric plate attached to a ground plane.

A third PIN diode is located in an opening in the dielectric plate, its cathode connected to the ground plane and its anode connected to the cathode of the first PIN diode to form a second node, the third PIN diode being substantially under the first PIN diode.

A fourth PIN diode is located in another opening in the dielectric plate with its cathode connected to the ground plane and its anode connected to the cathode of the second PIN diode to form a third node, the fourth PIN diode being substantially under the second PIN diode.

A first biasing circuit controls the voltage level at the first node, the first biasing circuit coupled to a control voltage terminal of the switch, and a second biasing circuit controls the voltage level at the second node, the second biasing circuit coupled to another control voltage terminal of the switch.

A first signal connection is coupled to the first node, and another signal connection is coupled to the first node or the second node.

BRIEF DESCRIPTION OF THE DRAWINGS

The above-mentioned and other features and advantages of this invention, and the manner of attaining them, will become appreciated and be more readily understood by reference to the following detailed description in conjunction with the accompanying drawings, wherein.

Figure 1:
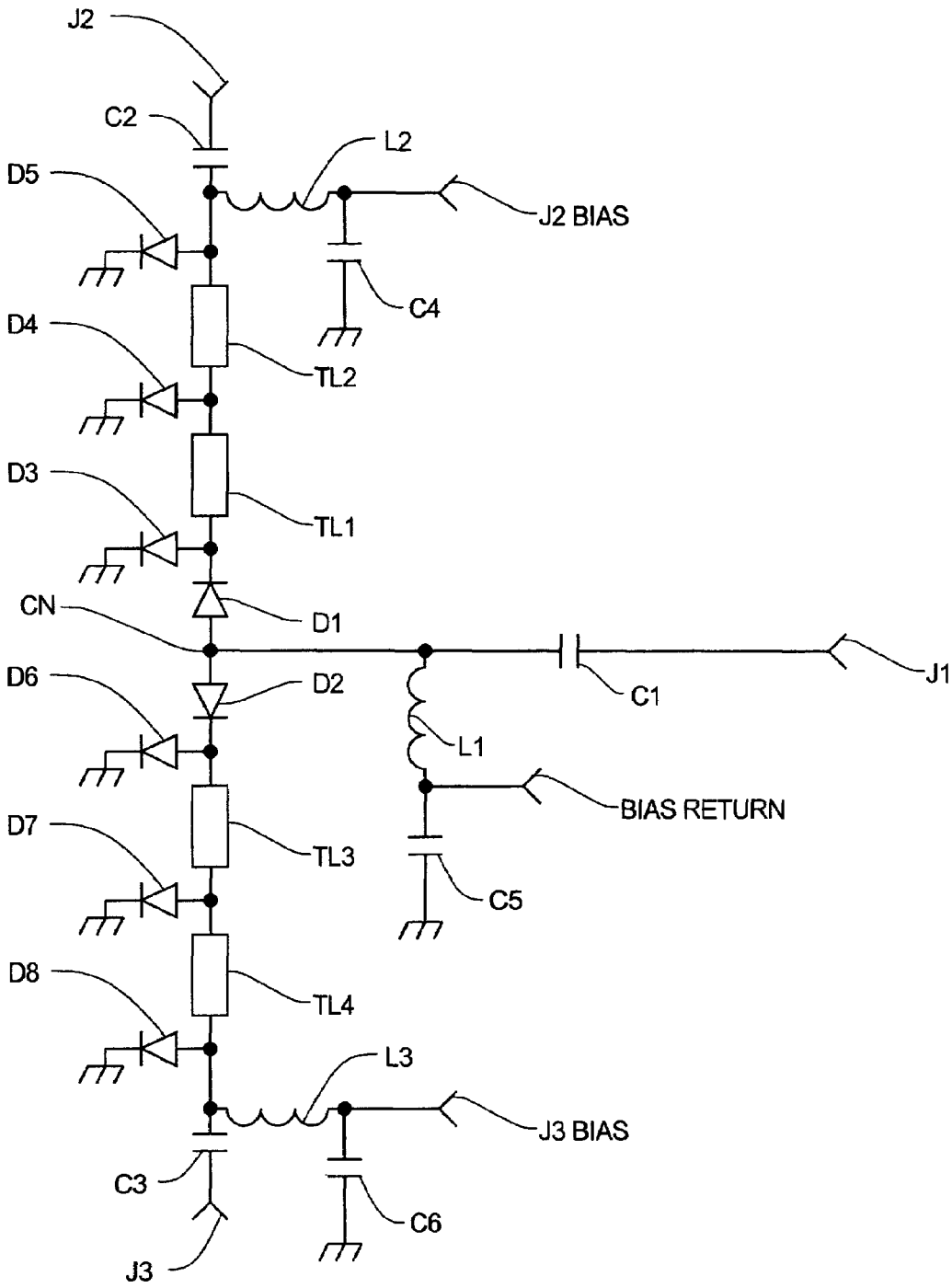
FIG. 1 is a schematic diagram of a single pole double throw PIN diode switch.

It will be appreciated that for purposes of clarity and where deemed appropriate, reference numerals have been repeated in the figures to indicate corresponding features, and that the various elements in the drawings have not necessarily been drawn to scale in order to better show the features of the invention.

DESCRIPTION OF THE PREFERRED EMBODIMENT

Referring to FIG. 1, a schematic representation of a single-pole double-throw (SPDT) series-shunt configured PIN diode switching circuit is shown. Beam lead PIN diodes D1 and D2 are mounted in series in the two arms of the switch, and are connected at their anodes to a central node (CN) of the switch. Shunt PIN diodes D3 and D6 couple the cathodes of PIN diodes D1 and D2, respectively, to ground.

Data signal input terminal J1 is coupled through capacitor C1 to the common node. The common node is also connected to a bias circuit that is connected to ground by a series connection of an inductor L1 and a capacitor C5. The node between the inductor L1 and capacitor C1 is connected to a BIAS RETURN voltage terminal.

In the first arm of the switch the PIN diode D1 is connected in series with transmission lines TL1 and TL2, and a capacitor C2 to a data signal output terminal J2. The anode of shunt PIN diode D4 is connected at the node between TL1 and TL2, and the anode of shunt PIN diode D5 is connected at the node between TL2 and C2. Another bias circuit consisting of the series connection of an inductor L2 and capacitor C4 couple the node between TL2 and C2 to ground. A first control voltage terminal labeled J2 BIAS, is connected to an input terminal at the node between L2 and C4. The voltage on J2 BIAS controls the conductivity of PIN diodes D1, D3, D4 and D5.

In the second arm of the switch the PIN diode D2 is connected in series with transmission lines TL3 and TL4, and a capacitor C3 to a data signal output terminal J3. The anode of shunt PIN diode D7 is connected at the node between TL3 and TL4, and the anode of shunt PIN diode D7 is connected at the node between TL4 and C3. A third bias circuit consisting of the series connection of an inductor L3 and capacitor C6 couple the node between TL4 and C3 to ground. A second control voltage terminal labeled J3 BIAS, is connected to an input terminal at to the node between L2 and C4. The voltage on J3 BIAS controls the conductivity of PIN diodes D2, D6, D7 and D8. In the bias circuits the inductors L1, L2 and L3 are broad band inductors.

In operation a signal path is enabled or disabled between J1 and J2 and between J1 and J3 depending on the voltages applied to the J2 BIAS and J3 BIAS control voltage terminals, respectively, as is well known in the art.

Figure 2:
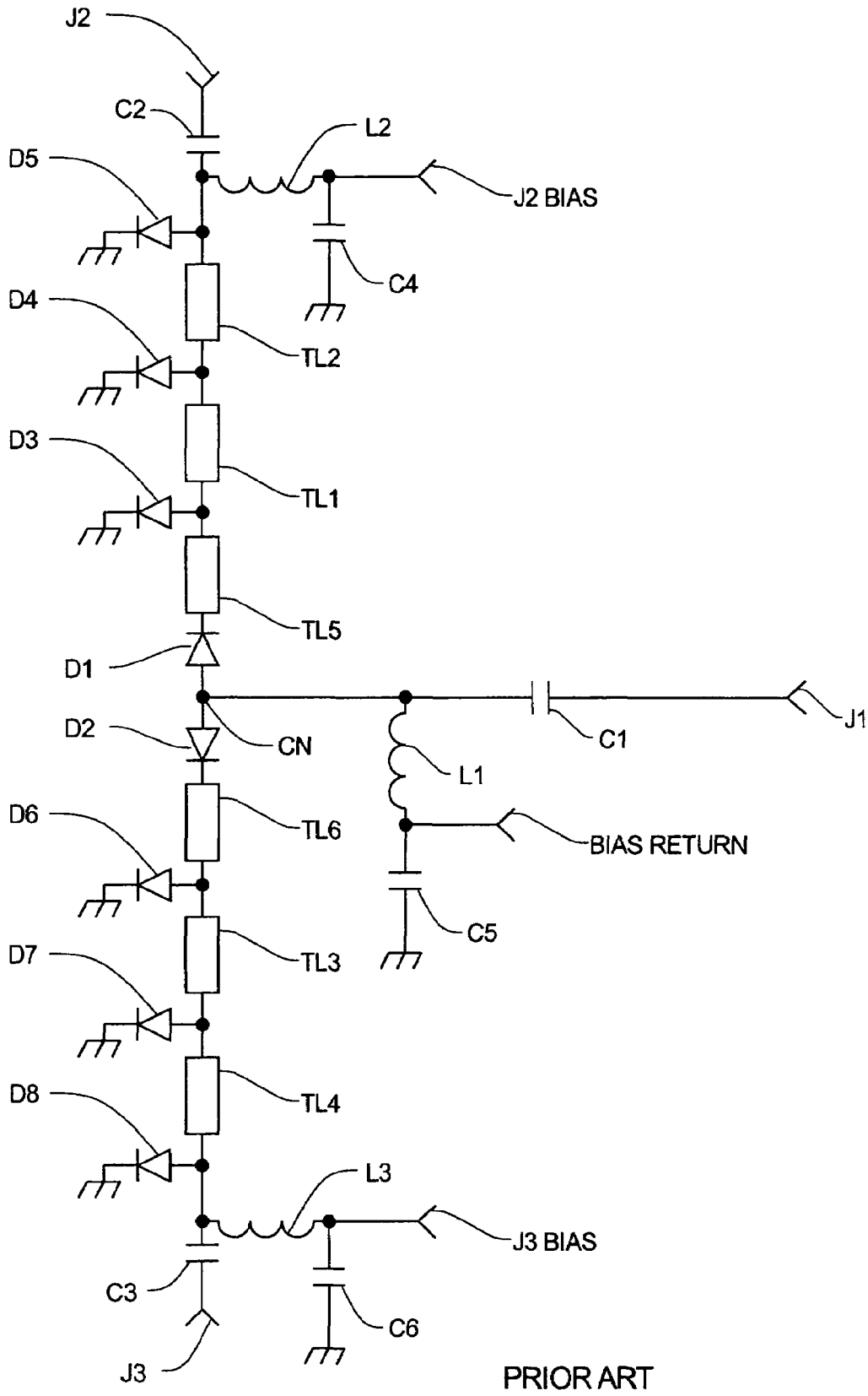
FIG. 2 is an equivalent circuit of the schematic diagram of FIG. 1 with the connections between the series and shunt PIN diodes shown as transmission lines.

Referring now to FIG. 2, the schematic of the circuit of FIG. 1 has been modified to show transmission lines TL5 and TL6 as equivalent circuits of the actual connection between series PIN diode D1 and shunt PIN diode D3, respectively, and the actual connection between series PIN diode D2 and shunt PIN diode D6, respectively. As stated in the Background of the Invention section above, as the upper frequency of the switch increases, these equivalent transmission lines TL5 and TL6 degrade the frequency performance of the switch and ultimately create an upper frequency limit that is classically around 18 or 20 GHz.

Figure 3:
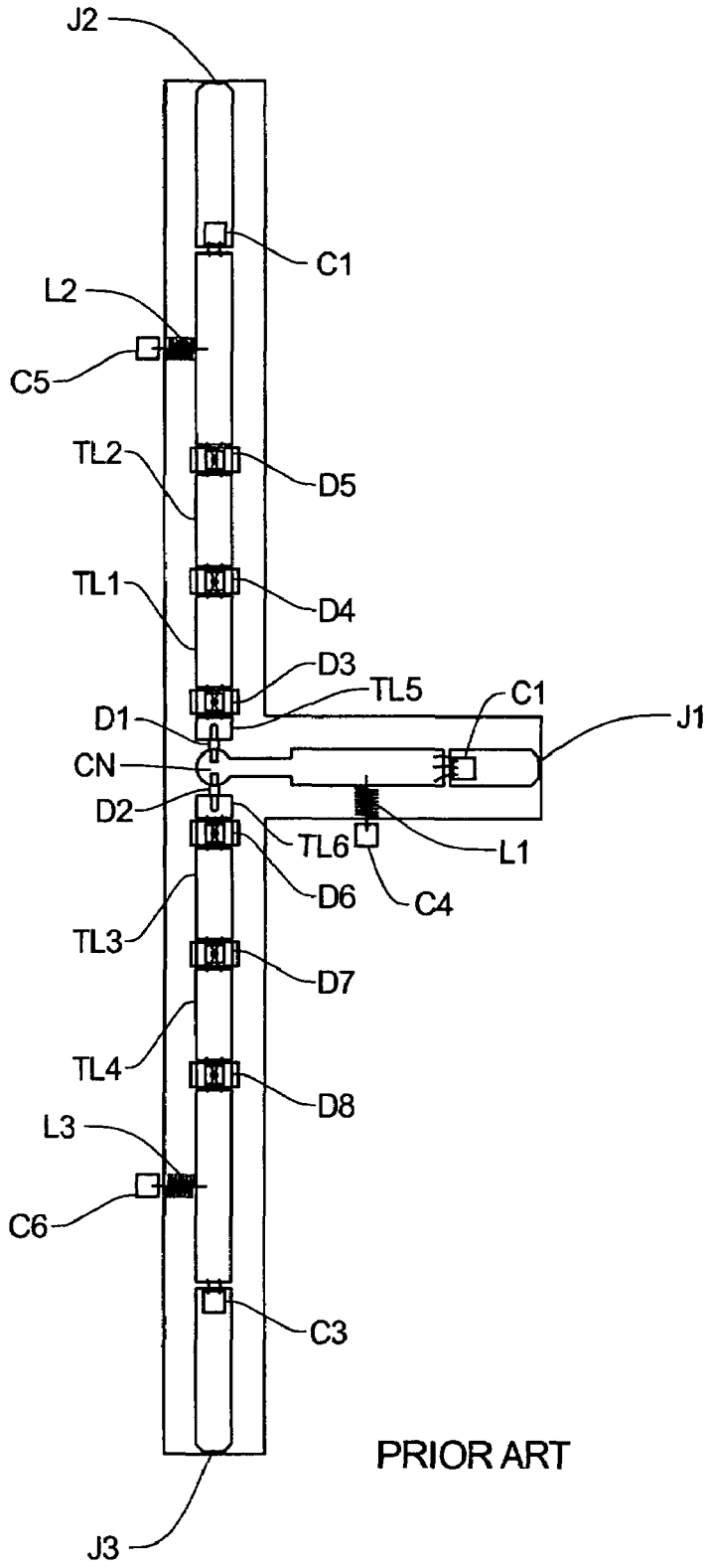
FIG. 3 is a top view of a prior art microline implementation of the single pole double throw PIN diode switch of FIG. 1.

FIG. 3 is a top view of a prior art microline implementation of the circuit of FIG. 1. The shunt PIN diodes D3–D8 have top and bottom contacts, and are located in openings in the dielectric (printed circuit board material in the preferred embodiment) and are connected to a ground plane on the bottom of the dielectric. Wire bonds are used to connect microline sections TL1–TL4 together and to the shunt PIN diodes D3–D8. The capacitors C1, C2 and C3 are bonded to sections of microline, and the top plates of the capacitors are wire bonded to adjacent microlines as is common in the art.

Figure 5A:
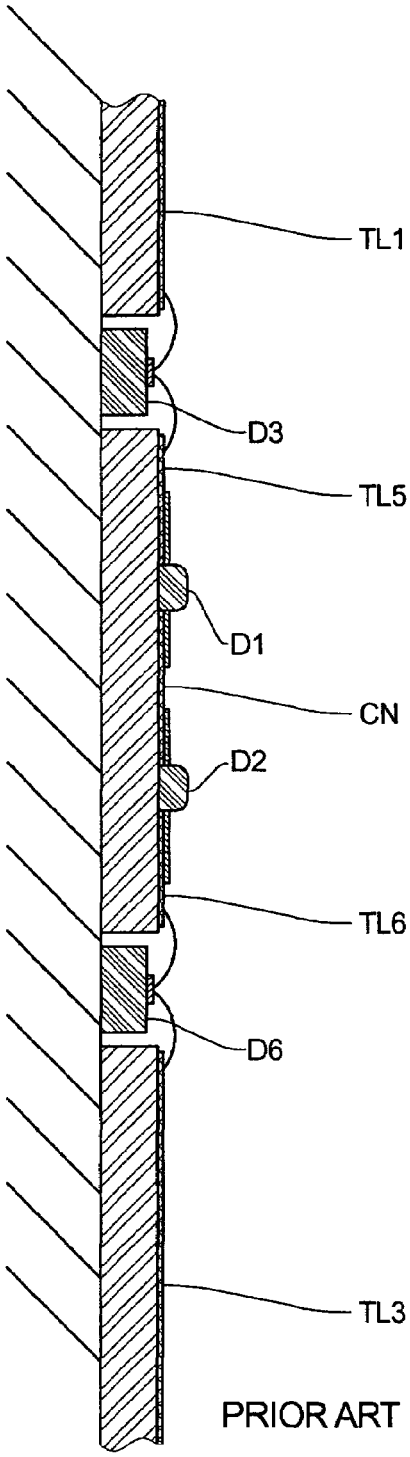
FIG. 5A is a cross sectional view of the microline implementation of FIG. 3.

FIG. 5A is a cross sectional view of the microline implementation of FIG. 3

Figure 4:
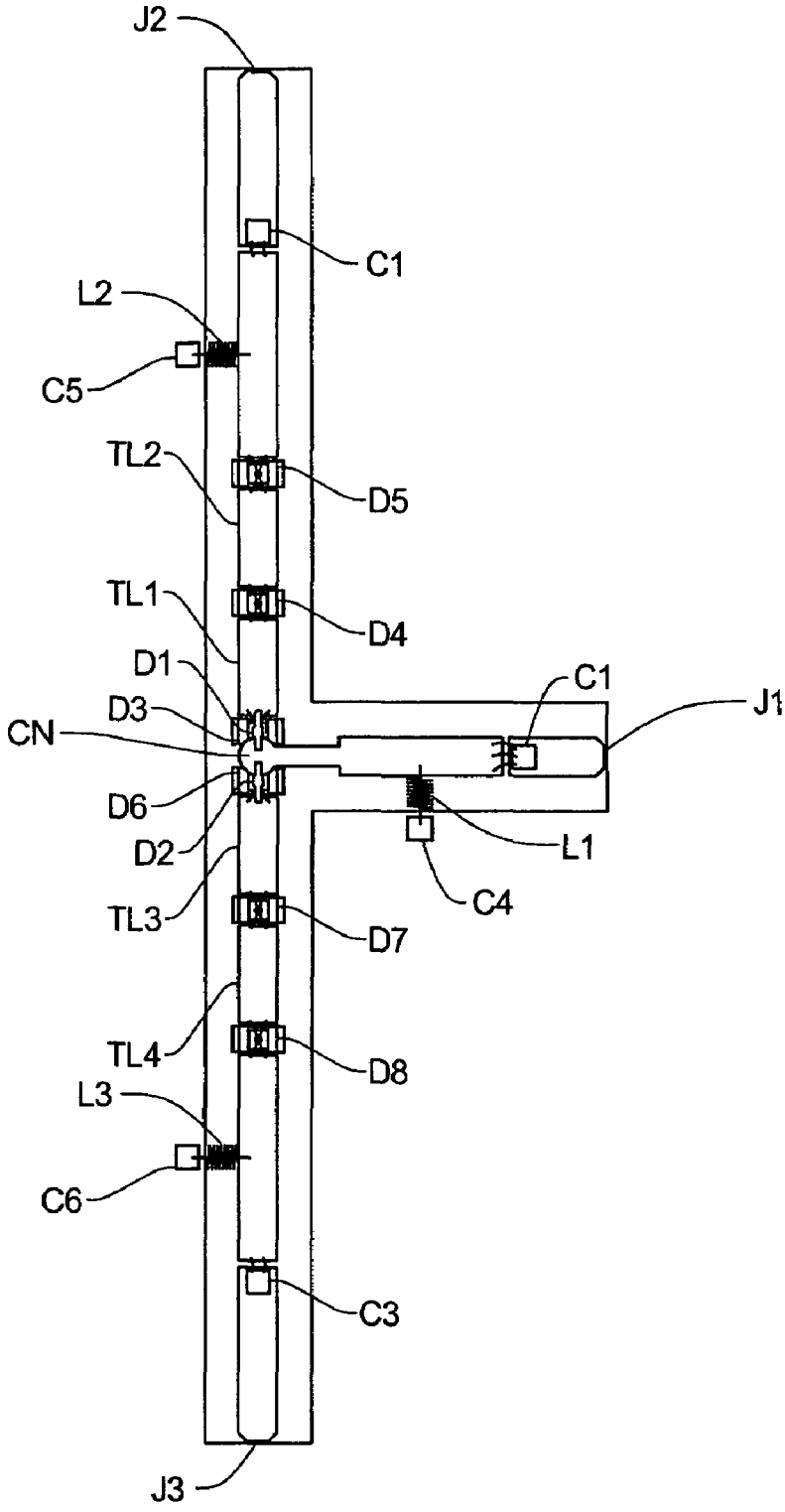
FIG. 4 is a top view of a microline implementation of the single pole double throw PIN diode switch of FIG. 1 according to the present invention.
Figure 6:
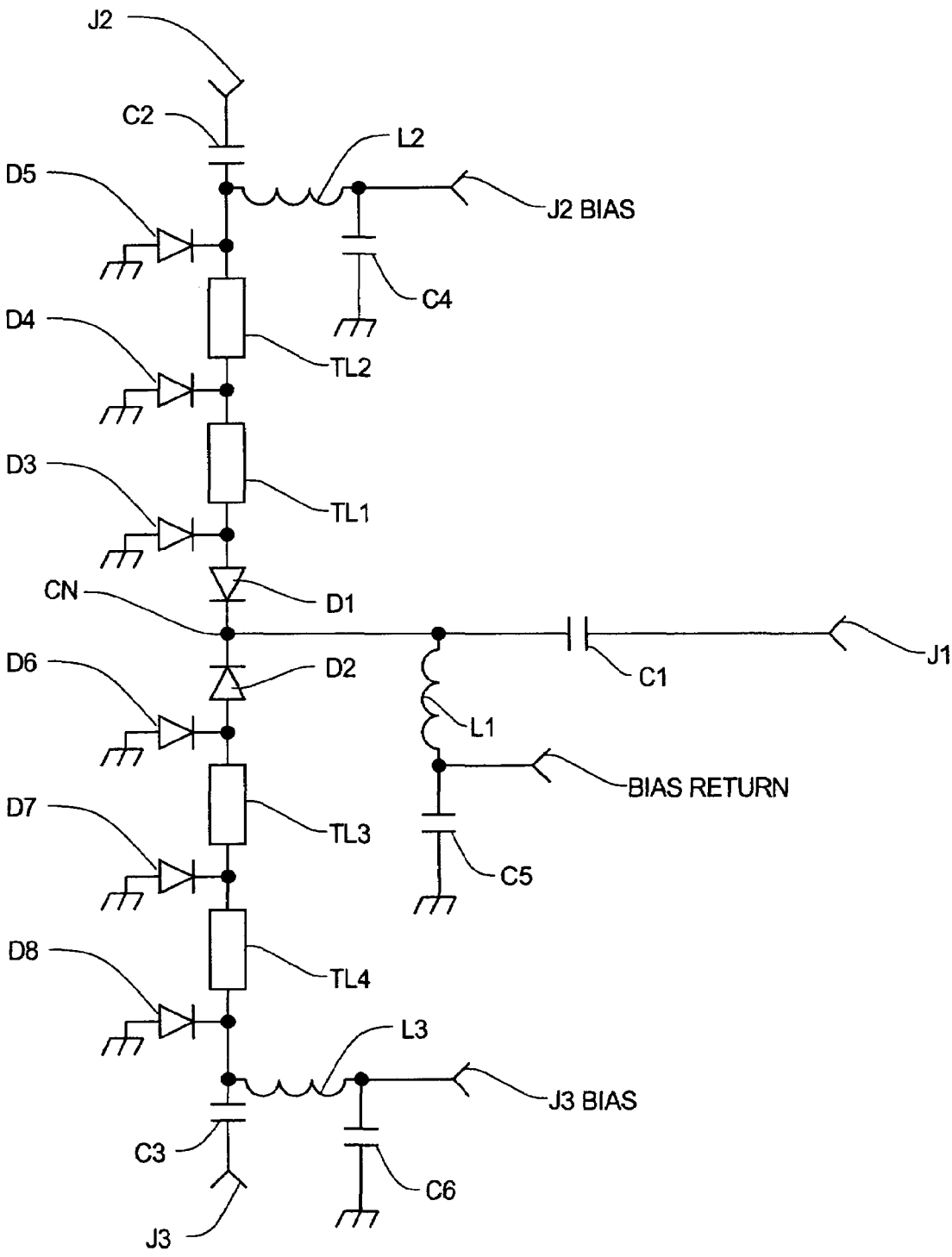
FIG. 6 is the circuit diagram of FIG. 1 with the polarities of the PIN diodes reversed.

FIG. 4 is a top view of a microline implementation of the circuits of FIG. 1 or 6 according to the present invention. In the implementation of FIG. 4 the shunt PIN diodes D3 and D6 are located in openings in the dielectric that are bridged by the series PIN diodes D1 and D2, respectively. For the polarities of the PIN diodes shown in FIG. 1, the anode of the shunt PIN diode D3 is wire bonded by wire bonds WB1 to transmission line TL1 and the cathode beam lead of the series PIN diode D1 is bonded to the transmission line TL1. Shunt PIN diode D6 and series PIN diode D2 are similarly attached by wire bonds WB2.

Figure 5B:
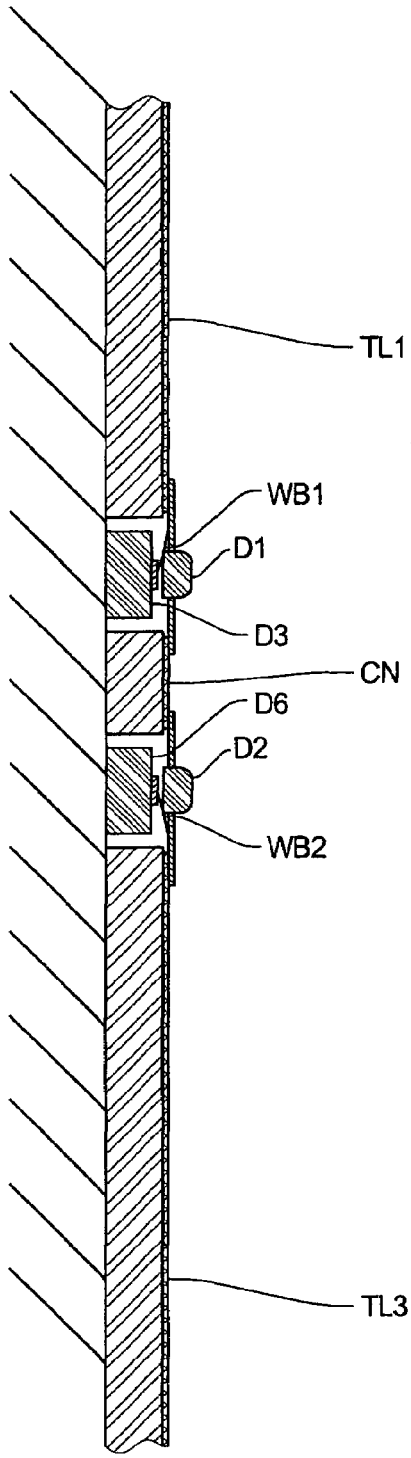
FIG. 5B is a cross sectional view of the microline implementation of FIG. 4.

FIG. 5B is a cross sectional view of the microline implementation of FIG. 4. It will be noted that the modifications in the microline implementation as shown in FIGS. 3 and 5A to the implementation as shown in FIGS. 4 and 5B are relatively simple. That is, the repositioning of the openings in the dielectric for PIN diodes D3 and D6, and the slight modification of the wire bonding of these PIN diodes being essentially the only changes required to implement the present invention.

The switch of FIG. 5B has operated up to 60 GHz which was the limit of the test capability used to evaluate this circuit. The circuit of FIG. 5B can operate in the frequency band of 0.5 to 60 GHz, a bandwidth of seven octaves.

FIG. 6 is the circuit diagram of FIG. 1 with the polarities of the PIN diodes reversed.

Figure 7:
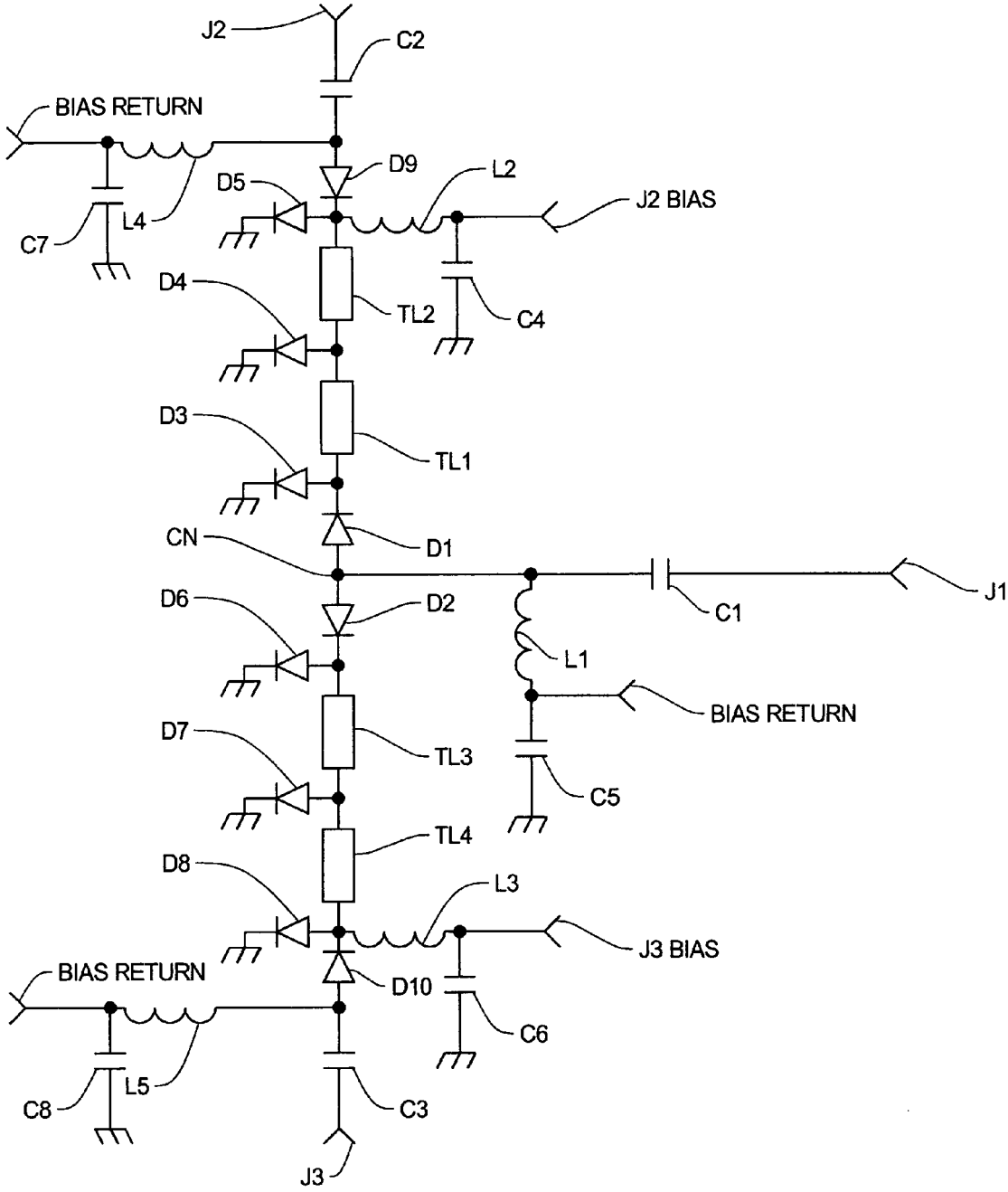
FIG. 7 is the circuit diagram of FIG. 1 with the addition of series diodes between the transmission lines and the capacitors at the signal connections of each of the two arms of the switch.

FIG. 7 is the circuit diagram of FIG. 1 with the addition of a series PIN diode D9 between the transmission line TL2 and the capacitor C2 and the addition of a series PIN diode D10 between the transmission line TL4 and C3. The series PIN diodes D9 and D10 have their anodes connected to capacitors C2 and C3, respectively. In addition to the added PIN diode D9, the node between PIN diode D9 and capacitor C2 is connected to a bias circuit that is connected to ground by a series connection of an inductor L4 and a capacitor C7. The node between the inductor L4 and capacitor C7 is connected to the BIAS RETURN voltage terminal. Similarly, in addition to the added PIN diode D10, the node between PIN diode D10 and capacitor C3 is connected to a bias circuit that is connected to ground by a series connection of an inductor L5 and a capacitor C8. The node between the inductor L5 and capacitor C8 is connected to the BIAS RETURN voltage terminal. In the microline implementation of the circuit of FIG. 7 PIN diode D9 is located over PIN diode D5 and PIN diode D10 is located over PIN diode D8 in the same manner as PIN diode D1 is located over PIN diode D3 and PIN diode D2 is located over PIN diode D6. With the additional series diodes and biasing circuits of FIG. 7 there is an increase in the loss in the low frequency range in an arm of the switch when the arm is biased off. The circuit of FIG. 7 operates in the same manner as the circuit of FIG. 1 but provides the increased OFF loss in the low frequency range.

Figure 8:
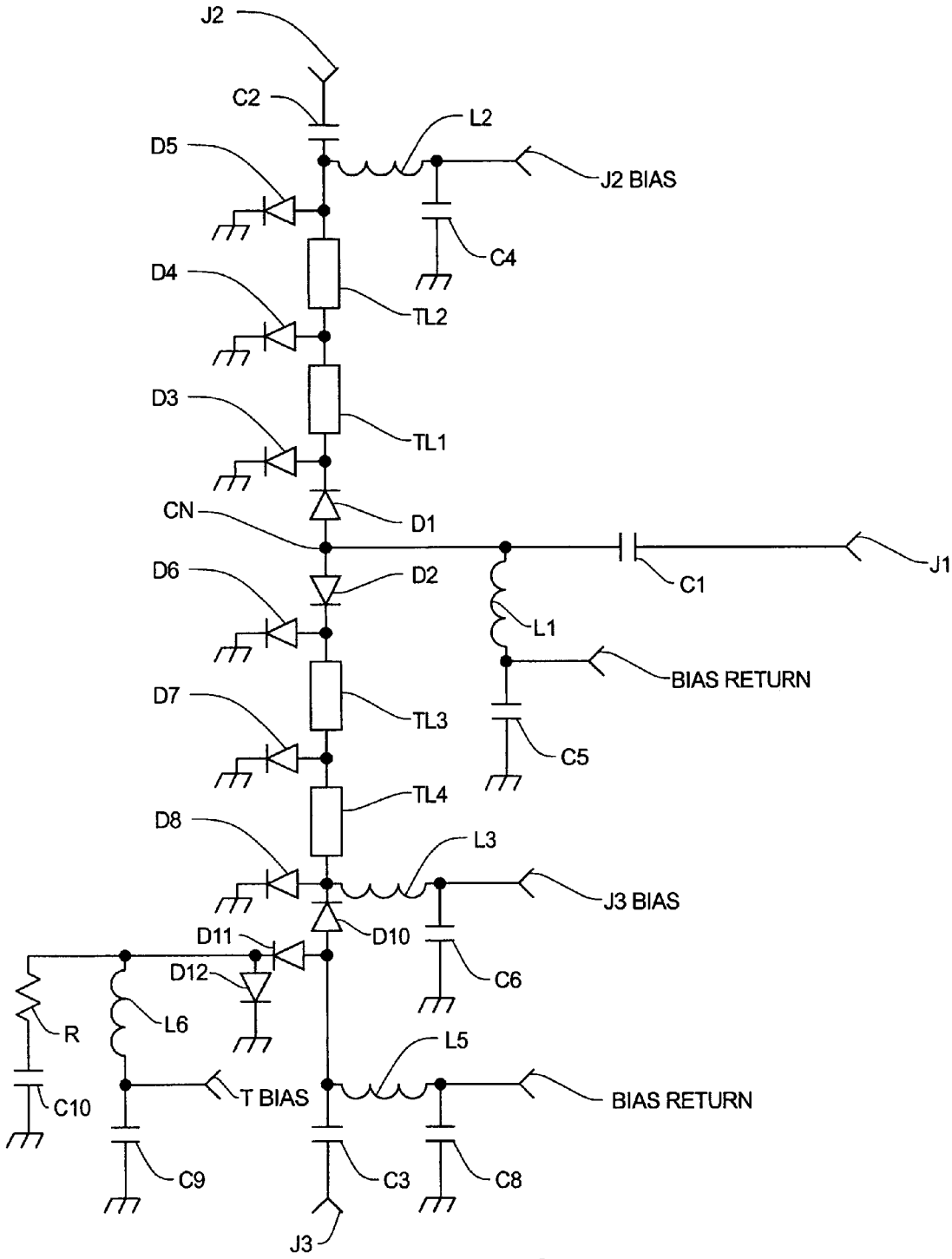
FIG. 8 is the circuit diagram of FIG. 1 with the addition of a termination circuit near one signal connection to the switch.

FIG. 8 is the circuit diagram of FIG. 1 with the addition of a termination circuit near the J3 signal connection to the switch. In addition to the series PIN diode D10 of FIG. 7 a series-shunt arrangement of two PIN diodes, D11 and D12, couples the anode of PIN diode D10 to ground through a series combination of a termination resistor R and a capacitor C10. PIN diode D11 has its anode connected to the anode of D10 and PIN diode D12 has its anode connected to the cathode of PIN diode D11 and its anode is connected to ground. A bias circuit consisting of a series connection of an inductor L6 and capacitor C9 connects the anode of PIN diode D12 and termination resistor R to ground. The node between the inductor L6 and capacitor C9 is connected to a T BIAS control voltage terminal. In the microline implementation of the circuit of FIG. 8 PIN diode D10 is located over PIN diode D8 and PIN diode D11 is located over PIN diode D12 in the same manner as PIN diode D1 is located over PIN diode D3 and PIN diode D2 is located over PIN diode D6.

In operation when the J3 BIAS voltage control terminal is high enough to turn off the corresponding arm of the switching circuit and the T BIAS voltage control terminal is low enough to forward bias the PIN diode D11 and reverse bias the PIN diode D12, the J3 signal input will be terminated by the termination resistor R. When the switching circuit is operating, the T BIAS control voltage terminal will have the opposite voltage as the J3 BIAS control voltage terminal.

In the preferred embodiment the shunt PIN diodes are GC42415-00 and the series PIN diodes are GC49978-12, both manufactured by Microsemi Corp. of Irvine, Calif.

Although the embodiment shown in the drawings is a SPDT switch, the present invention is applicable to SPST switches and to switches with more than two output arms. In addition, any number of shunt PIN diodes can be used in the arms. More shunt PIN diodes results in higher OFF loss. Also, terminals J1, J2 and J3 can be either input terminals or output terminals. For example, data signals applied at signal connections J2 and J3 (so that J2 and J3 are both input terminals), could be selectively switched to J1 (so that J1 is an output terminal).

The embodiments described are chosen to provide an illustration of principles of the invention and its practical application to enable thereby one of ordinary skill in the art to utilize the invention in various embodiments and with various modifications as a re suited to the particular use contemplated. Therefore, the foregoing description is to be considered exemplary, rather than limiting, and the true scope of the invention is that described in the following claims.

We claim:

1. A method of fabricating a series-shunt PIN diode switch for increasing the operating frequency of said switch comprising the steps of:

mounting at least one shunt PIN diode in an opening of a circuit board; and mounting at least one series PIN diode on a surface of said circuit board substantially directly above said at least one shunt PIN diode.

2. A switch comprising:

a) first and second PIN diodes having their respective anodes connected together at a first node of said switch, said first and second PIN diodes lying substantially on a top surface of a dielectric plate, a bottom surface of said dielectric plate having a ground plane attached thereto;

b) a third PIN diode located in a first opening in said dielectric plate with a cathode of said third PIN diode connected to said ground plane and an anode of said third PIN diode connected to a cathode of said first PIN diode at a second node, said third PIN diode being substantially under said first PIN diode;

c) a fourth PIN diode located in a second opening in said dielectric plate with a cathode of said fourth PIN diode connected to said ground plane and an anode of said fourth PIN diode connected to a cathode of said second PIN diode at a third node, said fourth PIN diode being substantially under said second PIN diode;

d) a first biasing circuit coupled to and controlling a voltage level at said first node, said first biasing circuit coupled to a voltage terminal;

e) a second biasing circuit coupled to and controlling a voltage level at said second node, said second biasing circuit coupled to a first control voltage terminal for controlling the conductivity of said first PIN diode;

f) a third biasing circuit coupled to and controlling a voltage level at said third node, said third biasing circuit coupled to a second control voltage terminal for controlling the conductivity of said second PIN diode;

g) a first signal connection coupled to said first node;

h) a second signal connection coupled to said second node; and i) a third signal connection coupled to said third node.

3. The switch of claim 2 further including strip transmission lines lying on said first surface of said dielectric material, a first transmission line of said strip transmission lines coupled between said second node and said second signal connection, and a second transmission line of said strip transmission lines coupled between said third node and said third signal connection.

4. The switch of claim 3 further including:

a) fifth and sixth shunt PIN diodes, each located in an opening is said dielectric and being connected at their respective cathodes to said ground plane and their anodes connected to each end of a third strip transmission line coupled between said first transmission line and said second control signal; and b) seventh and eighth shunt PIN diodes, each located in an opening is said dielectric and being connected at their respective cathodes to said ground plane and their anodes connected to each end of a fourth strip transmission line coupled between said second transmission line and said third control signal.

5. The switch of claim 3 further including:

a) a fifth PIN diode coupled between said first signal connection and said first node;

b) a sixth PIN diode located in a third opening in said dielectric plate with a cathode of said sixth PIN diode connected to said ground plane and an anode of said sixth PIN diode connected to a cathode of said fifth PIN diode at a fourth node, said sixth PIN diode being substantially under said first PIN diode; and c) a fourth biasing circuit coupled to an anode of said fifth PIN diode, said fourth biasing circuit coupled to said voltage terminal.

6. The switch of claim 5 further including:

a) a seventh PIN diode having an anode coupled between said anode of said fifth PIN diode and said first signal connection;

b) an eighth PIN diode having an anode coupled to a cathode of said seventh PIN diode and a cathode connected to said ground plane;

c) a resistor coupled between said cathode of said seventh PIN diode and said ground plane; and d) a fifth biasing circuit coupled to and controlling a voltage level at said cathode of said seventh PIN diode, said fifth biasing circuit coupled to a fourth control voltage terminal for controlling the conductivity of said seventh PIN diode.

7. The switch of claim 6 wherein said cathode of said seventh PIN diode and said a node of said eighth PIN diode are connected together and said eighth PIN diode is substantially under said seventh PIN diode.

8. A switch comprising:

a) first and second PIN diodes having their respective cathodes connected together at a first node of said switch, said first and second PIN diodes lying substantially on a top surface of a dielectric plate, a bottom surface of said dielectric plate having a ground plane attached thereto;

b) a third PIN diode located in a first opening in said dielectric plate with an anode of said third PIN diode connected to said ground plane and a cathode of said third PIN diode connected to an anode of said first PIN diode at a second node, said third PIN diode being substantially under said first PIN diode;

c) a fourth PIN diode located in a second opening in said dielectric plate with an anode of said fourth PIN diode connected to said ground plane and a cathode of said fourth PIN diode connected to an anode of said second PIN diode at a third node, said fourth PIN diode being substantially under said second PIN diode;

d) a first biasing circuit coupled to and controlling a voltage level at said first node, said first biasing circuit coupled to a voltage terminal;

e) a second biasing circuit coupled to and controlling a voltage level at said second node, said second biasing circuit coupled to a first control voltage terminal for controlling the conductivity of said first PIN diode;

f) a third biasing circuit coupled to and controlling a voltage level at said third node, said third biasing circuit coupled to a second control voltage terminal for controlling the conductivity of said second PIN diode;

g) a first signal connection coupled to said first node;

h) a second signal connection coupled to said second node; and i) a third signal connection coupled to said third node.

9. The switch of claim 8 further including strip transmission lines lying on said first surface of said dielectric material, a first transmission line of said strip transmission lines coupled between said second node and said second signal connection, and a second transmission line of said strip transmission lines coupled between said third node and said third signal connection.

10. The switch of claim 9 further including:

a) fifth and sixth shunt PIN diodes, each located in an opening is said dielectric and being connected at their respective anodes to said ground plane and their cathodes connected to each end of a third strip transmission line coupled between said first transmission line and said second control signal; and b) seventh and eighth shunt PIN diodes, each located in an opening is said dielectric and being connected at their respective anodes to said ground plane and their cathodes connected to each end of a fourth strip transmission line coupled between said second transmission line and said third control signal.

11. The switch of claim 9 further including:

a) a fifth PIN diode coupled between said first signal connection and said first node;

b) a sixth PIN diode located in a third opening in said dielectric plate with an anode of said sixth PIN diode connected to said ground plane and a cathode of said sixth PIN diode connected to an anode of said fifth PIN diode at a fourth node, said sixth PIN diode being substantially under said first PIN diode; and c) a fourth biasing circuit coupled to a cathode of said fifth PIN diode, said fourth biasing circuit coupled to said voltage terminal.

12. The switch of claim 11 further including:

a) a seventh PIN diode having a cathode coupled between said cathode of said fifth PIN diode and said first signal connection;

b) an eighth PIN diode having a cathode coupled to an anode of said seventh PIN diode and an anode connected to said ground plane;

c) a resistor coupled between said anode of said seventh PIN diode and said ground plane; and d) a fifth biasing circuit coupled to and controlling a voltage level at said anode of said seventh PIN diode, said fifth biasing circuit coupled to a fourth control voltage terminal for controlling the conductivity of said seventh PIN diode.

13. The switch of claim 12 wherein said anode of said seventh PIN diode and said cathode of said eighth PIN diode are connected together and said eighth PIN diode is substantially under said seventh PIN diode.

* * * * *